US011724377B2

(12) United States Patent
Marks

(10) Patent No.: US 11,724,377 B2
(45) Date of Patent: Aug. 15, 2023

(54) BOTTOM LOADING PLIERS STAPLER

(71) Applicant: Worktools, Inc., Chatsworth, CA (US)

(72) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 384 days.

(21) Appl. No.: 16/874,817

(22) Filed: May 15, 2020

(65) Prior Publication Data

US 2020/0376642 A1 Dec. 3, 2020

Related U.S. Application Data

(60) Provisional application No. 62/853,665, filed on May 28, 2019.

(51) Int. Cl.
*B25C 5/16* (2006.01)
*B25C 5/11* (2006.01)

(52) U.S. Cl.
CPC ..... *B25C 5/1696* (2013.01); *B25C 5/11* (2013.01)

(58) Field of Classification Search
CPC ... B25C 5/0292; B25C 5/0242; B25C 5/1696; B25C 5/11; B25C 5/0285
See application file for complete search history.

(56) References Cited

U.S. PATENT DOCUMENTS 2,580,505 A 1/1952 Blama
2,680,245 A 6/1954 Marano
2,801,414 A 8/1957 Mueller
3,103,012 A 9/1963 Kohen et al.
3,758,016 A 9/1973 Olney et al.
4,156,499 A 5/1979 Frank
4,225,075 A 9/1980 Chi
4,666,075 A 5/1987 Olesen
5,335,838 A 8/1994 Harris et al.
5,364,000 A * 11/1994 Fealey ..... B25C 5/0285 227/124
5,497,932 A 3/1996 Brewer et al.
5,699,949 A 12/1997 Marks
5,704,533 A * 1/1998 Chang ..... B25C 5/0285 227/124
5,816,470 A 10/1998 Plato et al.
5,988,478 A 11/1999 Marks
6,059,165 A 5/2000 Deng
6,076,720 A 6/2000 Deng
6,145,728 A 11/2000 Marks
6,286,745 B1 9/2001 Ackeret
6,918,525 B2 7/2005 Marks
7,395,955 B2 7/2008 Zins et al.
8,052,023 B2 11/2011 Co
(Continued)

*Primary Examiner* — Anna K Kinsaul
*Assistant Examiner* — Veronica Martin
(74) *Attorney, Agent, or Firm* — Rankin, Hill & Clark LLP

(57) ABSTRACT

A preferably pliers type stapler is disclosed with a staple loading structure that is both simplified and easy to operate. A lower handle and base are connected to the body through a pivoting and cam system. A single motion pulls the lower handle and base away from the body to expose a staple track location for loading staples at a bottom of the body. Preferably the same single motion releases the track to move outward from a rear of the body. In one embodiment a compact simplified structure using a preferably torsion spring provides a low cost reliable spring energized system.

18 Claims, 4 Drawing Sheets

(56) References Cited

U.S. PATENT DOCUMENTS

| | | | | |
|---|---|---|---|---|
| 8,550,322 | B2 | 10/2013 | Marks | |
| 8,668,128 | B2 | 3/2014 | Marks | |
| 9,586,311 | B2 | 3/2017 | Choy | |
| 2009/0114698 | A1* | 5/2009 | Marks | B25C 5/11 227/139 |

* cited by examiner

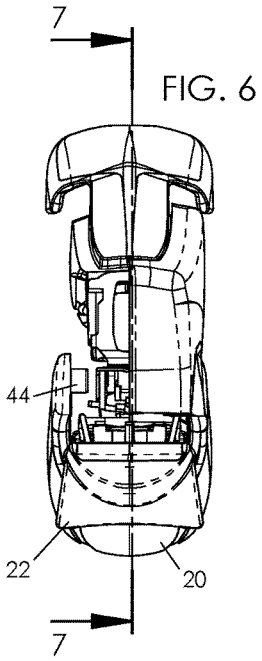
FIG. 6
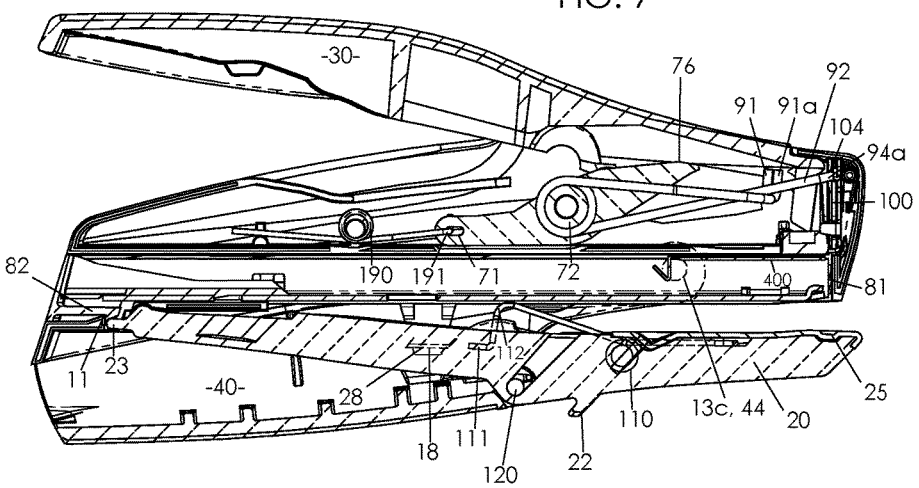
FIG. 7
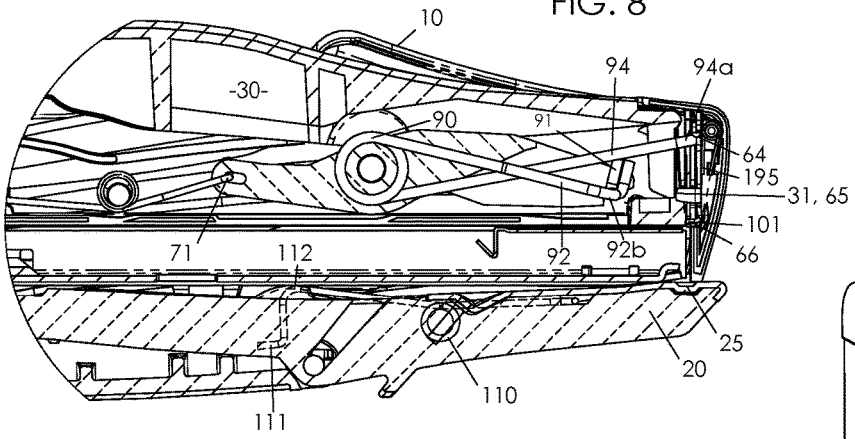
FIG. 8
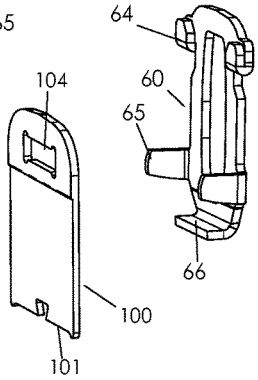
FIG. 11
FIG. 10
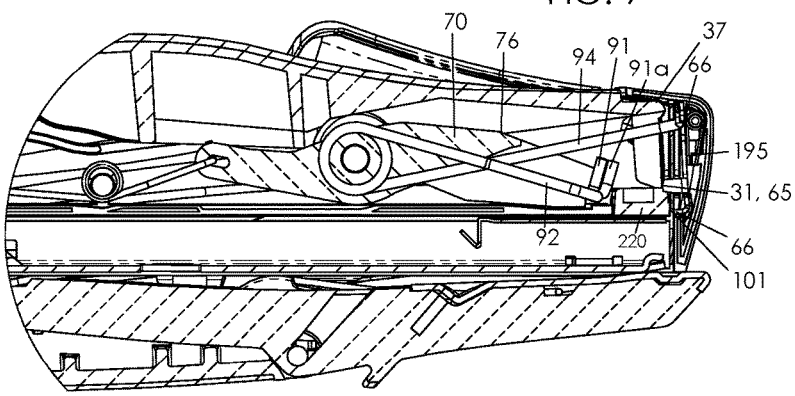
FIG. 9

BOTTOM LOADING PLIERS STAPLER

PRIORITY CLAIM

This application claims priority to U.S. Provisional Application Ser. No. 62/853,665, filed May 28, 2019.

FIELD OF THE INVENTION

The present invention relates to stapling tools. More precisely the present invention relates to a pliers stapler with bottom loading access.

BACKGROUND

Pliers type staplers are known. The stapler is held in the hand and a handle is squeezed at or near the stapler's rear end to clinch a staple at its front end. Typically a base with a staple anvil is fitted to a body while the handle is pivotally attached to at least one of the base and body. Staples are loaded into a track of the stapler for example by inserting at the rear or installing through or around the body from the top. Another option has the track extendable out of the front to receive staples. With the base typically pivoted at the rear of the body and the handle pivoted at the front these prior loading solutions are complex, inconvenient, and/or prone to jamming.

Staplers, including pliers type, may be directly actuated or spring energized. Direct acting pliers staplers typically suffer from substantial sliding and friction of the loaded parts and thus are not efficient. Spring energized pliers staplers have been complex and not reliable.

SUMMARY OF THE INVENTION

In various preferred embodiments, the present invention is directed to a preferably pliers stapler with a staple or fastener loading structure that is both simplified and easy to operate. A lower handle and base are connected to the body through a pivoting and cam system. A single motion pulls the lower handle and base away from the body to expose a staple track location along a bottom of the body. Preferably the same single motion releases the track to move outward from a rear of the body to reveal a staple track chamber able to receive staples.

The illustrated embodiment shows a spring energized stapler wherein the energy stored in a power spring installs a staple by impact blow. A compact simplified structure using a preferably torsion spring provides a low cost reliable spring energized system.

BRIEF DESCRIPTION OF THE DRAWINGS

FIG. 6 is a front elevation view, partly in section, of the stapler of FIG. 1.

FIG. 7 is a side elevation view, partly in section, of the stapler of FIG. 1.

FIG. 8 is a cropped view of the stapler of FIG. 7 in an initial pressed condition.

FIG. 9 is the view of FIG. 8 in a fully pressed condition.

FIG. 10 is a side rear perspective view of a striker.

FIG. 11 is a side rear perspective view of a latch.

DETAILED DESCRIPTION OF THE PREFERRED EMBODIMENTS

Figure 1:
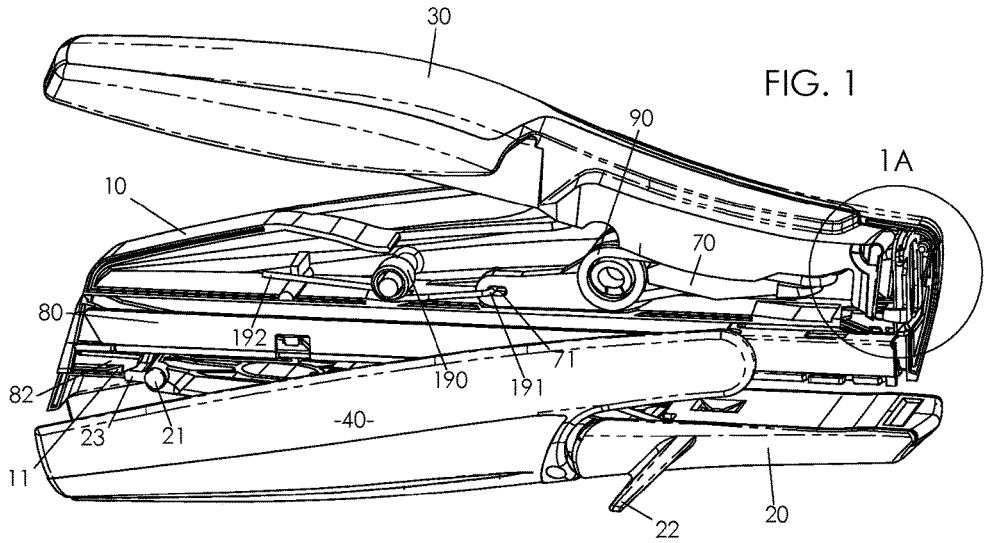
FIG. 1 is a side top perspective view of a preferred embodiment stapler in a rest condition, with a right housing portion omitted to reveal internal elements.
Figure 13:
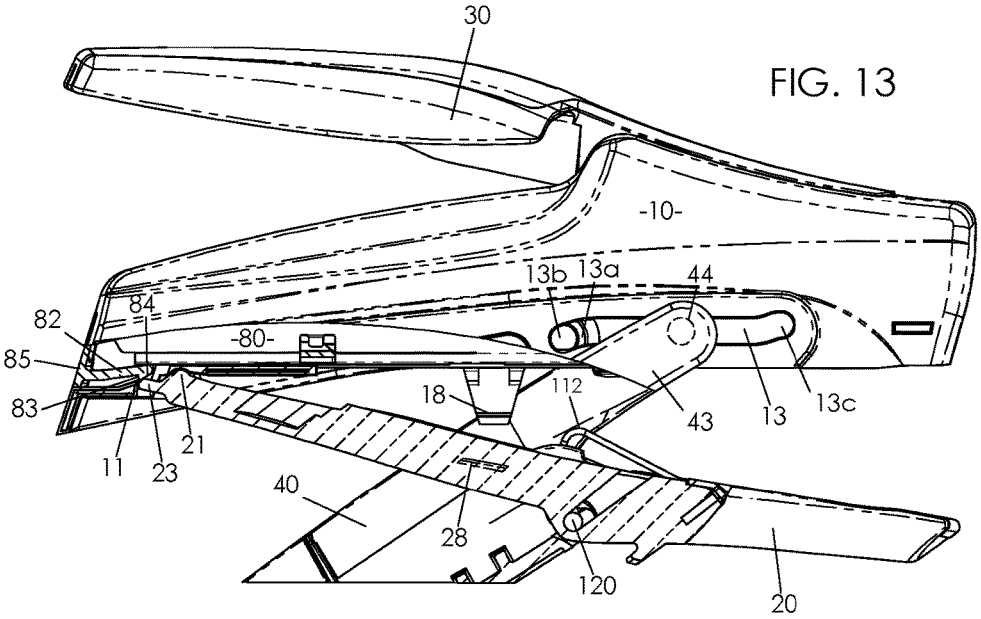
FIG. 13 is a side elevation view of preferred embodiment stapler with a base initially opened for staple loading.
Figure 14:
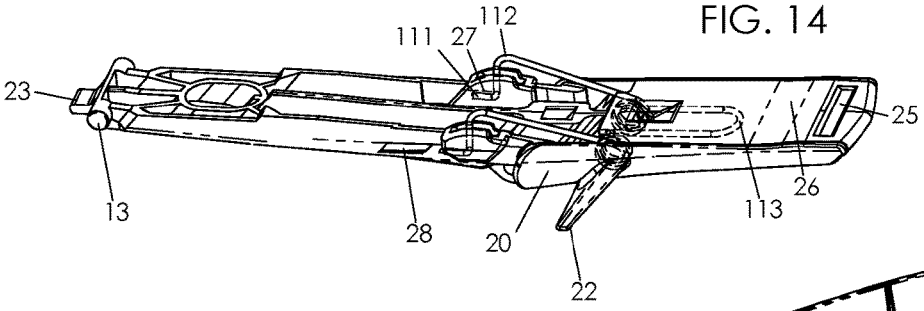
FIG. 14 is a side, top perspective view of a stapler base assembly.
Figure 15:
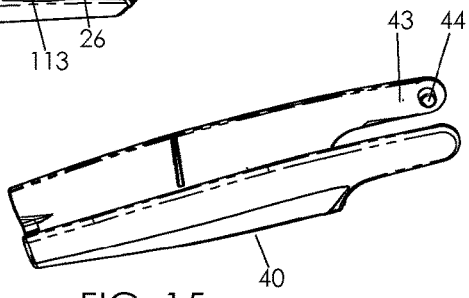
FIG. 15 is a side top perspective view of a stapler lower handle.

In the present invention a compact efficient stapler includes improvement to staple loading, and in one embodiment, a simplified spring energized driving action. The drawings are to proportionate scale. The pliers stapler has opposed pressing areas or locations near a rear of the device whereby the tool is squeezed to provide motion of the mechanism for a stapling or operating cycle. In the example of FIG. 7 upper handle 30 and lower handle 40 provide these opposed structures with respective rearward portions having locations to be squeezed. The upper handle may be more generally described as a "staple cycling input lever" whereby moving the upper handle in relation to a further component of the stapling device causes a staple insertion cycle to occur. The lower handle may be described as a "base cycling input lever" whereby it causes the base to move in relation to a further component of the stapling device. FIG. 1 has a right housing half removed for clarity. Two halves of housing 10 form a stapler housing body or simply "body". Housing 10 supports and guides functional parts including upper handle 30, lower handle 40 and base 20. Upper handle 30 is pivoted toward a front of the body at hinge 37, FIG. 1A. Base 20 is pivoted toward a rear at base hinge 21 and centrally to lower handle 40 at pin 120. The base and lower handle thus share a pivoting linkage at pin 120 to enable the lower handle to pull on the base to move the base open to the position of FIG. 16. Lower handle 40 is slidably pivoted at pivot 44 in housing slot 13 at recess 13*c*, FIGS. 7, 13 and 15. Lower handle 40 includes a rest position of FIG. 1, a pressed lower handle position of FIG. 12, and an open lower handle position of FIG. 17. FIG. 13 shows a rearward position of pivot 44 in slot 13, discussed later. In operational use upper handle 30 and lower handle 40 are squeezed together whereby the upper handle pivots downward for example from the rest position of FIG. 1 to the pressed position of FIG. 8. Concurrently lower handle 40 pivots upward under the squeeze force. The link at pin 120 causes base 20 to pivot upward toward the body so that anvil 25 is proximate a bottom of the body, FIG. 8. Base spring 110 or equivalent structure, FIG. 14, presses beneath the body at end 112 to resiliently link the base to the body and bias the base and lower handle away from the body. Spring front end 113 presses under cover plate 26 to leverage the rear at end 112. In FIG. 14 spring leg 111 fits to a slot in base to abut base edge 27 to limit an upper position of end 112. In this manner the spring will de-link from the housing body and not urge the base lower than its normal operating limit of FIG. 7. This lower base position is set by a resilient detent engagement between housing rib 18 and base rib 28, FIGS. 7, 13, and 14. When the stapler is squeezed spring end 112 retracts into the base to allow the base, along with lower handle 40, to move up to their respective pressed positions of FIG. 8. The pressed position of FIG. 8 shows anvil 25 pressing up directly against body 10. In normal use there is a space between the body and base here to accommodate papers and the like to be stapled, with such pressed position space being less than the rest position space of FIG. 7. The pressed position may be considered having the base being proximate the body wherein the respective elements are pressed together directly or through any papers or the like, while the rest position has the base near but spaced from the body.

In each of the base rest and pressed positions base 20 confines the track chamber 16 from below and blocks or obstructs access to the track chamber. For example in FIG. 7 the distance between anvil 25 and the bottom of the body directly above is about ¼ inch. This is adequate to fit 20 sheets of paper for example but there is no reasonable way to install a rack of staples by fingers into the track chamber. So it is desired that base 20 can open further as in FIG. 16 to expose and provide practical operative access to track chamber 16 for the operation of loading fasteners into the exposed chamber. For such access track 80 is in the track open position of FIG. 17 wherein both of the base and track are moved away from chamber 16 to enable staples and the like to be placed into the chamber.

Figure 12:
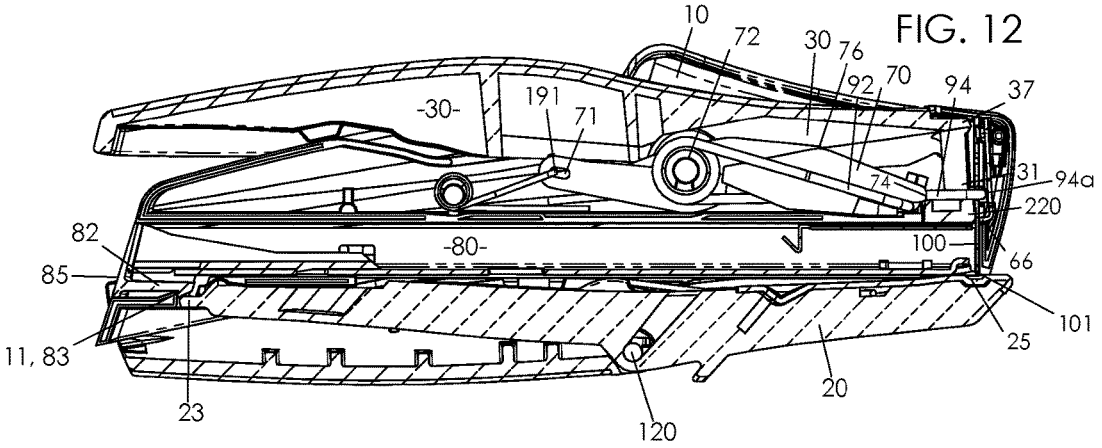
FIG. 12 is the stapler of FIG. 7 in a released condition and the link in normal, non-sectioned, view.

Track 80 is held in its operative forward location by detent 83 of track pull 85 against rib 11 of the housing, FIG. 12 for example. To load staples lower handle 40 is pushed downward from its rest position of FIG. 7 to cause base 20 to also pivot downward through the connection at pin 120. The lower handle is pulled until the base is moved past the detents of ribs 18 and 28 from the base rest position of FIG. 7 to the initial opened position of FIG. 13. Lower handle pivot 44 slides rearward (to the left in FIG. 13) from its normal location at recess 13*c* in slot 13. The resulting cam action forces base 20 to the downward position shown. In FIG. 13 arm 82 of track pull 85 is deflected by rib 23 of base 20. Rib 23 then presses cam face 84 to urge the track to the unlatched partly rearward position of FIG. 16. Arm 82 is no longer deflected and track 80 is free to be pulled out to its rear most position of FIG. 17. With base 20 adequately out of the way track front end 81 is toward a rear of track chamber 16 whereby the chamber is well exposed and unconfined by the base or track in front of lower handle 40. The chamber is available for placing a rack of staples.

In FIG. 13 recess 13*c* has an upward jog while recess 13*b* jogs downward. These jogs enhance the vertical motion of operating the base opening sequence. In particular pivot 44 moves downward by these additional jogs to further cause base 20 to assume a larger open angle. Also in FIG. 13 recess 13*b* is defined by raised rib 13*a* in slot 13. Rib 13*a* creates a detent action to flex lower handle arms 43 outward and lightly snap and retain the post of pivot 44 in the fully open lower handle condition of FIG. 16. This selective retention prevents base 20 from falling closed, by gravity for example, as staples are loaded to track chamber 16.

Figure 16:
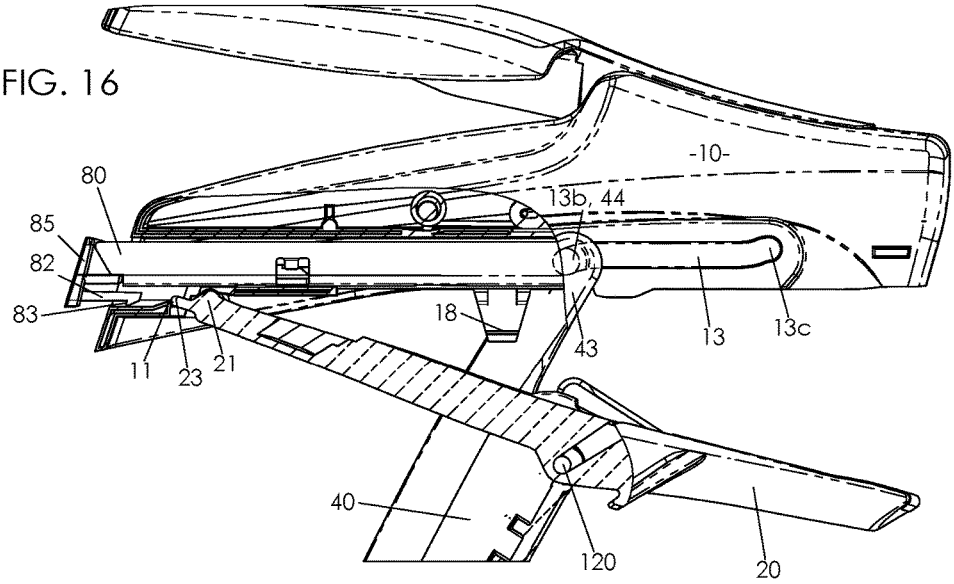
FIG. 16 is the stapler of FIG. 13 with the base fully opened and a track partly extended.
Figure 17:
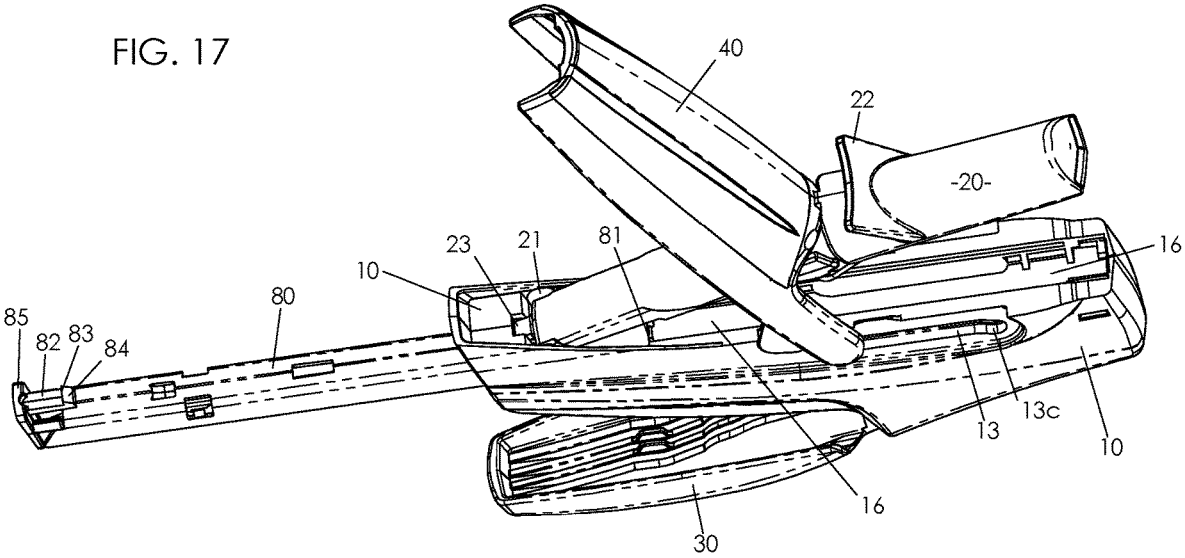
FIG. 17 is a bottom, side, perspective view the stapler of FIG. 16 with the track fully extended to expose a track chamber.

In FIG. 16 the base forms an angle of at least 10 degrees relative to the extended orientation of the track to enable access to the track chamber. This angle is equivalently relative to the bottom of the body wherein body lower extent is substantially coincident with the track bottom at the front region where staple loading occurs. As shown this angle is about 20 degrees. In contrast the rest position, FIG. 7, and pressed position, FIG. 8, have these elements substantially parallel. Recesses 13*b* and 13*c* comprise selective hinge locations for body-to-lower handle pivot locations, with the hinge locations spaced apart preferably at ends of slot 13.

Once staples are loaded lower handle 40 is closed whereby the lower handle and base are in respective operative positions of FIGS. 1 and 8 with the track chamber confined from below by the base. Track 80 is then pushed in or closed to latch detent 83. Optionally rib 23 may be deleted or modified whereby the track does not automatically open. Arm 82 may then be configured to be manually pressed, for example near the location of rib 23 in FIG. 17, to release the track from its latched forward position. In this case the track would start from the forward latched position rather than the extended position as actually shown in FIG. 17. Further rib 23 may be resiliently retractable lengthwise into base 20 whereby closing the track causes rib 23 to retract against a force from cam face 84. In this manner rib 23 does not cause the track to reopen while base 20 is in the open position. As the base is closed rib 23 lightly springs rearward on or from base 20 to re-enable its functional configuration shown in FIG. 13. These are among the means contemplated to disable the track de-latching action while the base is open. Pusher 400, FIG. 7, biases staples toward the front of the track.

Figure 2:
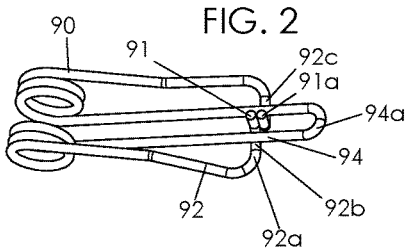
FIG. 2 is a top, front perspective view of a power spring in a rest condition according to a preferred embodiment.
Figure 2A:
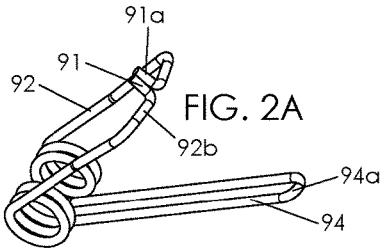
FIG. 2A is the spring of FIG. 2 in a free position.

In the Figures an improved spring energized stapling structure is shown. Torsion power spring 90 includes an engagement of first spring end 94*a* to striker 100 at opening 104, FIGS. 1A, 2 and 10. A rest condition of the spring is shown in FIGS. 2 and 7. At least one wire of a first spring arm 94 extends between the spring coil and end 94*a*. Second spring arm 92 includes bend 92*a* and segment 92*b*. In the rest condition segment 92*b* hooks to arm 94 to hold the spring in a pre-loaded condition. Leg 91 forms a vertical portion of a hook to preferably retain segment 92*b* from moving laterally (out of the page in FIG. 7). FIG. 2A shows a free unloaded condition of the spring wherein segment 92*b* is deflected and spaced above arm 94. As shown power spring 90 is preferably a double torsion type with substantially symmetric features. An exception is legs 91 and 91*a* and their adjacent spring elements, i.e. the relative angle of segment 92*b* vs 92*d*. In FIG. 2 these legs are preferably aligned lengthwise rather than, for example, side by side. This alignment allows a laterally compact structure consistent with the spring fitment to link 70 and striker 100 as discussed below.

Figure 3:
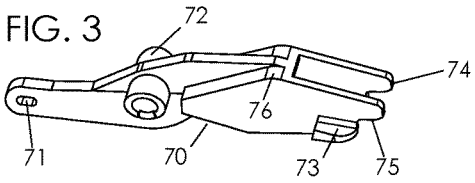
FIG. 3 is a top, front perspective view of a link.
Figure 4:
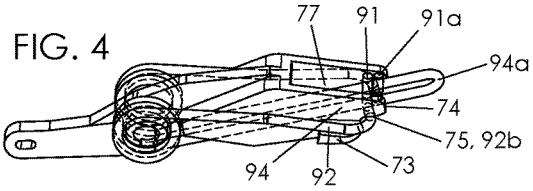
FIG. 4 is a sub-assembly of the link and power spring in a pre loaded spring rest condition.
Figure 5:
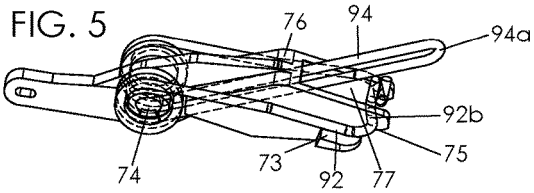
FIG. 5 is the sub-assembly of FIG. 4 in a spring pressed condition.
Figure 1A:
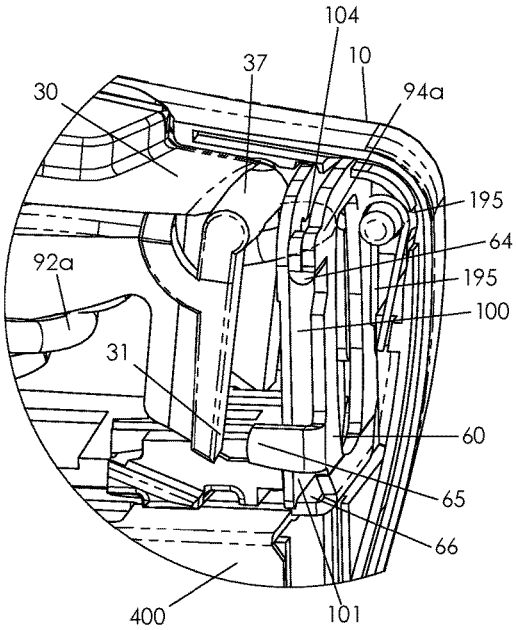
FIG. 1A is a detail view of FIG. 1 showing an upper front area.

Link 70 is pivotally mounted to housing 10 at pivot 72. The link further engages handle 30 at link fulcrum 76, FIG. 12. Pressing the handle toward the body thereby causes handle 30 to rotate about hinge 37 and link 70 to rotate clockwise in the views. Hinge 37, fulcrum 76 and pivot 72 are substantially aligned or collinear through their motions to minimize sliding and friction as the parts move. Link 70 links the handle to the power spring and includes tab 75 and rib 73. These features cooperate to hold spring segment(s) 92*b*, 92*c*, and thus arm(s) 92, in a substantially set vertical position upon the link, FIGS. 3 to 5. First spring end 94*a* forms a loop as shown that engages opening 104 of the striker. In FIG. 1A the rest condition has striker 100 held in its upper position by latch tab 66 against striker lower edge 101. With spring end 94*a* held still in the striker upper position, pressing upper handle 30 moves link 70 to cause tab 75 to press segment 92*b* and force the first and second spring arms apart. FIGS. 5, 8 and 9 show this spring energized condition. Link 70 is preferably made from a low friction material such as acetal or the like.

Latch 60 holds the striker in the upper position for all conditions other than the released condition or state of FIG. 12 and during a re-set motion to restore the assembly to the rest condition of FIG. 7. With reference to FIGS. 1A, 10 and 11, latch tab 66 extends under edge 101 of striker 100. The tab is at an about 90 degree angle to the striker length direction whereby the latch is stable under the striker as the striker presses downward against the latch at shelf 66. As the upper handle rotates arms 31 of the handle approach tabs 65 of the latch until contact occurs in the pressed condition of FIG. 8. From here both upper handle 30 and latch 60 move together to the pre-release position of FIG. 9, with the latch rotating about pivots 64. Shelf 66 is no longer under edge 101 so striker 100 is free to move under the bias of power spring 90 to the lower striker position of FIG. 12. Note the position of lower edge 101 near anvil 25 or, equivalently, at the bottom of housing 10.

As illustrated the first spring arm comprises wires of two arms 94 joined by a loop at end 94*a*, although a single wire forming a single arm 94 is contemplated. To fit the preferred loop of spring end 94*a* into engagement with opening 104 the loop should have a smallest practical bend radius. Therefore the two illustrated symmetric arms 94 should be close as possible together. As discussed above legs 91 and 91*a* are portions of hooks to help retain the spring in the rest condition for assembly and use. The legs are aligned lengthwise, this being in a slot formed by arms 94, FIG. 2. This contrasts with a lateral alignment with the two legs spanning a width of the slot. Further with arms 94 near each other in a two wire first arm structure as described the first arm structure fits within a compact opening 77 of link 70. Beside the first arm are tabs 75 and then second spring arms 92. The spring-link subassembly of FIGS. 4 and 5 thereby fits within a compact stapler body.

The power spring is assembled to link 70 in an off line operation. The coils are spread apart and placed on posts of pivot 72. Arms 92 are pressed from below to spread slightly to clear ribs 73 and become stably held between ribs 73 and tabs 75.

A re-set stroke moves the stapler assembly from the released condition of FIG. 12 to the rest condition of FIG. 7. Re-set spring 190 presses downward on a rear arm of link 70 at opening 71, FIG. 1, through a reaction at spring arm 192. With rib 73 of the link confining the power spring from below, power spring 90 is rotated counter clockwise along with link 70. Striker 100 thus moves upward until latch 60 rotates rearward to click under lower edge 101. Latch bias spring 195 provides the gentle bias for the re-set action upon the latch. The bias torsion spring is assembled about the post shown in FIG. 1A and presses the latch on a left latch side so that the spring is stable in the assembly before a right housing half is assembled.

A spring energized pliers stapler is shown and described above. The structure can also operate as a direct acting non-spring power stapler with certain modifications. Power spring 90 is omitted. Link 70 is modified to extend end 74 to engage opening 104 of striker 100, see FIG. 12 for this end in context of the spring powered embodiment. The link is preferably modified to be made from a steel form at least near the extended area that engages striker 100 in a structure that is otherwise functionally equivalent to link 70 as illustrated. The link thus has sufficient strength for the concentrated forces at striker opening 104 to press a staple or fastener into a work piece. As with the spring energized embodiment the direct action stapler described here is efficient with minimal sliding friction between the parts wherein most moving contacts are substantially by pivoting. The bottom staple loading structures disclosed are operable to the same advantage with either of a spring energized or direct action stapler.

While the particular forms of the invention have been illustrated and described, it will be apparent that various modifications can be made without departing from the spirit and scope of the invention. It is contemplated that elements from one embodiment may be combined or substituted with elements from another embodiment.

The invention claimed is:

1. A stapler device, comprising:

a housing body including a track chamber along a bottom thereof;

a staple cycling input lever pivotably attached to the housing body;

a staple track extending within the track chamber, the staple track including a closed operative position under the housing body, and a track-open position extending rearward from the housing body;

a striker movable in the housing body between an upper position above the staple track and a lower position in front of the staple track;

a base pivotally attached to the housing body near a rear of the housing body at a base-body pivot location;

a lower handle pivotally attached to the housing body forward of the base-body pivot location;

the base pivotally attached to the lower handle at a base-lower handle pivot near a central location of the base, the base and lower handle thereby having a shared rotatable linkage, and rotating the lower handle upon the housing body causes the base also to rotate about the housing body through the base-lower handle pivot;

wherein the base includes three positions, being a pressed position, a rest position, and an open position, the pressed position having the base being proximate the body wherein the base and the body are pressed together under one of two conditions: (1) directly, or (2) through a spacing to accommodate papers to be stapled, wherein the base is spaced from the body in the rest position by a spacing greater than a spacing of any condition of the pressed position, wherein the base is pivotable from the rest position to be further from the body in the open position, wherein the shared rotatable linkage enables motion of the lower handle to cause motion of the base between the three positions, wherein the base extends along a bottom of the housing body and confines the track chamber from below in each of the pressed and rest positions of the base, and wherein the base open position includes the track chamber being exposed and open from a bottom of the stapler to enable operative access to the track chamber.

2. The stapler device of claim 1, wherein the base open position includes the base being angled downward by between 10 and 20 degrees in relation to the bottom of the housing body.

3. The stapler device of claim 1, wherein operative access to the track chamber is enabled when the track is in the track-open position.

4. The stapler device of claim 1, wherein the lower handle is pivotally attached to the housing body selectively at first and second hinge locations of the body.

5. The stapler device of claim 4, wherein the first hinge location is forward of the second hinge location, the lower handle engages the first hinge location when the base is in each of the base pressed position and the base rest position, and the lower handle engages the second hinge location when the base is in the base open position.

6. The stapler device of claim 5, wherein the hinge locations are at respective ends of a slot of the housing body, and the lower handle includes a structure that engages the slot and is enabled to slide along the slot between the two hinge locations as the lower handle moves from a lower handle rest position to a lower handle open position.

7. The stapler device of claim 5, wherein a detent rib adjacent the second hinge location releasably holds the lower handle in the lower handle open position corresponding to the base open position.

8. The stapler device of claim 1, wherein the staple cycling input lever forms an upper handle pivotally attached upon an upper portion of the housing body, and the upper handle is separately pivotable upon the housing from the lower handle.

9. A fastening device, comprising:

a housing body including a track chamber along a bottom thereof;

a staple track extending within the track chamber, the staple track including a closed operative position under the housing body, and a track-open position extending rearward from the housing body;

a striker movable vertically in the housing body between an upper position above the staple track and a lower position in front of the staple track;

a handle movably attached to the housing body and extending rearward below the bottom of the housing body, the handle including a handle rest position; and a base including a base rest position spaced near from the bottom of the housing body;

wherein the base is pivotable from the rest position to be further from the body in the open position, wherein the base confines the track chamber to be open from the bottom of the housing body, wherein the base includes a base open position in which the base is moved away from the housing body to expose the track chamber, wherein the base is linked to the handle such that moving the handle causes the base to move from the base rest position to the base open position, wherein the base is pivotally attached to the housing body near a rear of the housing body at a base-body hinge location, wherein the handle is pivotally attached to the housing body at a handle-body hinge location forward of the base-body hinge location, and wherein the base and handle are pivotally attached together at a base-handle pivot location.

10. The fastening device of claim 9, wherein the handle-body hinge location is movable between at least two separate locations of the housing body, being a first handle-body hinge location corresponding to the base rest position and a second handle-body hinge location corresponding to the base open position.

11. The fastening device of claim 9, wherein the track chamber is exposed in the base open position to enable operative access to the track chamber.

12. The fastening device of claim 11, wherein the base forms an angle of at least 10 degrees relative to the bottom of the housing body to enable access to the track chamber.

13. The fastening device of claim 11, wherein the base forms an angle of at least 20 degrees relative to the bottom of the housing body to enable access to the track chamber.

14. A pliers stapler device, comprising:

a housing body including a track chamber;

a track movable within the track chamber between a track operative forward position and a track rear position;

a striker movable at a front of the housing body between an upper position above the staple track and a lower position in front of the staple track;

a base pivotally attached at a rear location of the housing body including a base pressed position proximate a bottom of the housing body, a base rest position spaced from the bottom of the housing body, and a base open position with the base moved downward from the rest position;

wherein the track chamber is exposable to be open from a bottom of the stapler to enable loading of staples when the base is in the base open position and the track is in the track rear position, wherein the stapler device includes respective upper and lower pressing locations at a rear of the stapler device such that squeezing the pressing locations toward each other during an operating cycle of the stapler device causes the base to move from the rest position to the pressed position, wherein the base is pivotally attached to the housing body near the rear of the housing body at a base-body hinge location, wherein a lower handle is pivotally attached to the housing body at a handle-body hinge location forward of the base-body hinge location, and wherein the base and lower handle are pivotally attached together at a base-handle pivot location.

15. The pliers stapler device of claim 14, wherein the base is substantially parallel to the track in the base rest position, and the base is angled by at least 10 degrees relative to the track in the base open position.

16. The pliers stapler device of claim 15, wherein the base is angled by at least 20 degrees relative to the track in the base open position.

17. The pliers stapler device of claim 14, wherein a latch selectively holds the track in the operative forward position, and the latch links to the base between the base rest position and the base open position to cause the latch to release the track to enable the track to move toward the track rear position.

18. The pliers stapler device of claim 14, wherein an upper handle is pivotally linked to the base, the upper handle including a rear portion comprising the upper pressing location.

* * * * *